US005797188A

United States Patent [19]

Gilbert

[11] Patent Number: 5,797,188

[45] Date of Patent: Aug. 25, 1998

[54] HAND-HELD UTILITY KNIFE

[75] Inventor: Richard Gilbert, Dronfield, United Kingdom

[73] Assignee: The Stanley Works Limited, Sheffield, England

[21] Appl. No.: 810,762

[22] Filed: Mar. 5, 1997

[30] Foreign Application Priority Data

Mar. 6, 1996 [GB] United Kingdom ..... 9604748

[51] Int. Cl.[6] ..... B26B 5/00

[52] U.S. Cl. ..... 30/330; 30/331; 30/332

[58] Field of Search ..... 30/329, 332, 331, 30/330

[56] References Cited

U.S. PATENT DOCUMENTS

| | | | |
|---|---|---|---|
| 4,524,518 | 6/1985 | West | 30/330 |
| 4,604,805 | 8/1986 | Krieger | 30/330 |
| 4,662,070 | 5/1987 | Reddig | 30/294 |

FOREIGN PATENT DOCUMENTS

| | | | |
|---|---|---|---|
| 4009-905-A | 10/1991 | Germany | 30/330 |
| 2 265 104 | 9/1993 | United Kingdom | B26B 1/08 |

OTHER PUBLICATIONS

Stanley Tools catalog page for 10–550 Super Heavy Duty Utility Knife with holster, 1995.

*Primary Examiner*—Hwei-Siu Payer
*Attorney, Agent, or Firm*—Alix, Yale & Ristas, LLP

[57] ABSTRACT

A hand-held utility knife (20) has two handle portions (22, 23) hinged together at the rear end (26) of the handle (21) by means of two lugs (36, 37) of one handle portion (22) projecting into two recesses or cavities (38, 39) of the other handle portion (23) and retained therein behind two lips (53*a*, 53*b*) except when almost closed together, when the two handle portions (22, 23) can be separated and reconnected. In order to prevent inadvertent separation of the two handle portions (22, 23) at their rear ends (24, 25) when the handle is closed and the clamping device (27) is screwed up tight, the lugs (36, 37) have abutment portions (61, 62) which engage abutments (65, 66) inside the two recesses or cavities (38, 39). The abutments (61, 62, 65, 66) are positioned on one side of the hinging axis (34) so that they move apart when the handle (21) is opened. Hence the abutments (61, 62, 65, 66) do not interfere with the hinging of the handle portions (22, 23) nor with their separation and reconnection.

3 Claims, 5 Drawing Sheets

HAND-HELD UTILITY KNIFE

FIELD OF THE INVENTION

This invention relates to a hand-held utility knife.

The invention relates more particularly to a hand-held utility knife of a type comprising an elongate handle formed by two elongate handle portions, rear ends of said handle portions being hinged together at a rear end of the handle, said handle portions being releasably clamped together by a releasable clamping device positioned forwardly of the rear end of the handle and rearwardly of a front end of the handle;

the hinging together of the handle portions being by means of direct interlocking inter-engagement of the rear ends of the handle portions;

said direct interlocking inter-engagement of the rear ends of the handle portions being such that, when the clamping device is released, the two handle portions can be hinged apart and together, on a hinging axis at the rear end of the handle, so as to open and close the front end of the handle;

said direct interlocking inter-engagement of the rear ends of the handle portions also being such that, when the clamping device is released, the two handle portions can be completely disengaged from each other, and re-engaged with each other, at their rear ends, and thereby can be separated, and reconnected, when the handle portions are held at one particular predetermined angle, but not at other angles, relative to each other, the two handle portions being adapted to clamp a blade therebetween at the front end of the handle, with the plane of the blade parallel to the hinging axis.

PRIOR ART

A known example of such a type of knife is that made by ourselves and listed in our catalogue as knife No. 10-550, hereinafter referred to as the "10-550" knife.

The direct interlocking inter-engagement of the rear ends of the handle portions of the "10-550" knife is by means of two lugs on a first one of the handle portions projecting into two recesses or cavities of the second handle portion. Each lug projects generally rearwardly of said first handle portion and has a lateral extension adapted and arranged so that the extension can be introduced into and extracted from the recess or cavity of the second handle portion through a restricted opening thereof when the handle portions are held at said one particular predetermined angle, but not at said other angles, relative to each other.

The releasable clamping device of the "10-550" knife comprises a manually rotatable screw-threaded device captively held by one of the handle portions and a mating screw-threaded part of the other handle portion. Because the releasable clamping device of the "10-550" knife is positioned forwardly of the rear end of the handle, indeed close enough to the front end of the handle for the blade to be clamped effectively, the clamping device is rather ineffective to prevent the rear ends of the two handle portions from tending to move apart from each other when the knife is supposed to be closed.

Other prior art is British patent specification No. GB2265104A (STANLEY) and U.S. Pat. No. 4,662,070 (REDDIG).

SUMMARY OF THE INVENTION

According to the invention there is provided a hand-held utility knife comprising an elongate handle formed by two elongate handle portions, rear ends of said handle portions being hinged together at a rear end of the handle, said handle portions being releasably clamped together by a releasable clamping device positioned forwardly of the rear end of the handle and rearwardly of a front end of the handle;

the hinging together of the handle portions being by means of direct interlocking inter-engagement of the rear ends of the handle portions, due to at least one lug of a first one of the handle portions projecting into at least one recess or cavity of the second handle portion, said at least one lug projecting generally rearwardly of said first handle portion and having a lateral extension adapted and arranged so that said extension can be introduced into and extracted from said recess or cavity of the second handle portion through a restricted opening into said recess or cavity when the handle portions are held at one particular predetermined angle, but not at other angles, relative to each other, said direct interlocking inter-engagement of the rear ends of the handle portions being such that, when the clamping device is released, the two handle portions can be hinged apart and together, on a hinging axis at the rear end of the handle, so as to open, and close the front end of the handle;

said direct interlocking inter-engagement of the rear ends of the handle portions also being such that, when the clamping device is released, the two handle portions can be completely disengaged from each other, and re-engaged with each other, at their rear ends, and thereby can be separated, and reconnected, when the handle portions are held at said one particular predetermined angle, but not at said other angles, relative to each other, the two handle portions being adapted to clamp a blade therebetween at the front end of the handle, with the plane of the blade parallel to the hinging axis;

characterised in that mutually engageable abutments at the rear ends of the two handle portions are adapted to rest again movement apart of the two handle portions at the rear end of the handle when the handle is closed; said mutually engageable abutments being provided one on the or each lug and another in the or each recess or cavity; the relative positions of the hinging axis, on the one hand, and of said mutually engageable abutments, on the other hand, being such that the abutments move apart when the handle is hinged open. Preferably, said releasable clamping device comprises a manually rotatable screw-threaded device captively held by one of the handle portions and a mating screw-threaded part of the other handle portion.

The invention will be described by way of example with reference to the drawings, which illustrate a knife forming a preferred embodiment of the invention.

DETAILED DESCRIPTION OF THE PREFERRED EMBODIMENT

Figure 1:
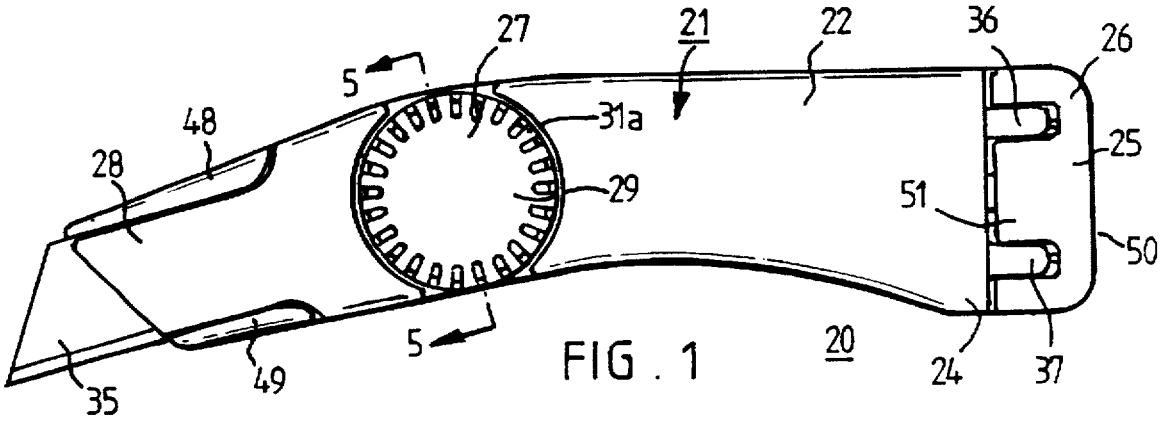
FIG. 1 is a side elevation, showing the left-hand side, of the knife forming the preferred embodiment of the invention.
Figure 2:
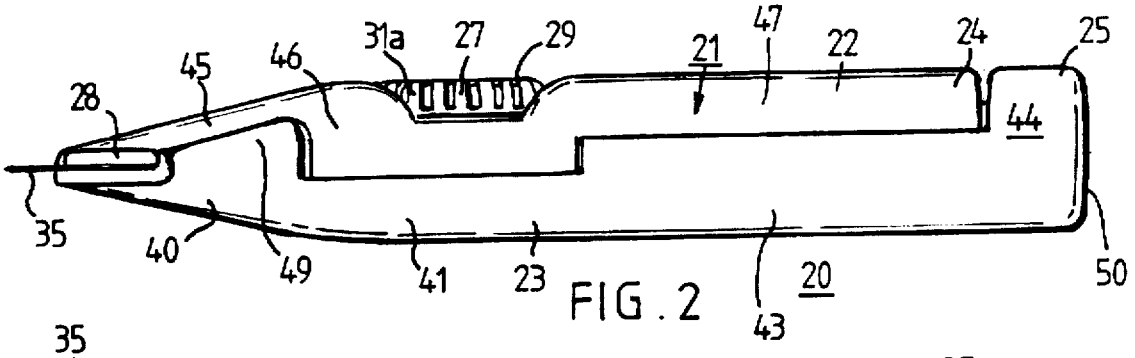
FIG. 2 is an underneath plan view of the knife.
Figure 3:
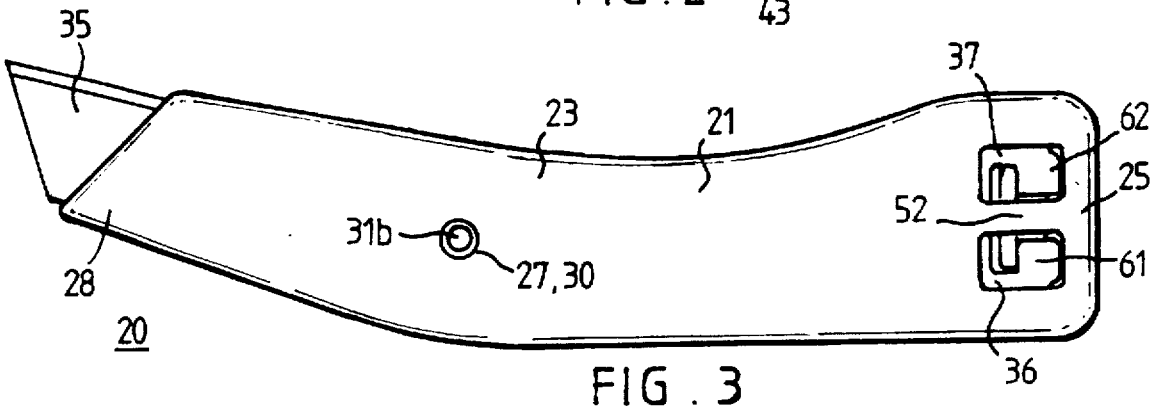
FIG. 3 is a side elevation, showing the right-hand side, of the knife on its back.
Figure 4:
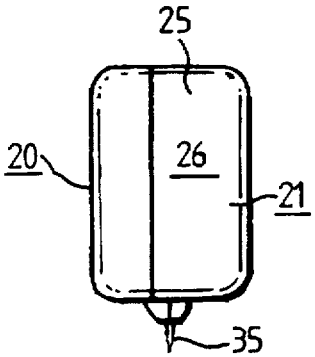
FIG. 4 is a rear end view of the knife.

Referring to the drawings, the knife 20 is a hand-held utility knife of the above-mentioned type, and comprises an elongate handle 21 formed by two elongate handle portions, namely, a first elongate handle portion 22 and a second elongate handle portion 23. As shown in FIGS. 1, 2 and 3, rear ends 24, 25 respectively of handle portions 22, 23 are hinged together at a rear end 26 of the handle 21.

Figure 5:
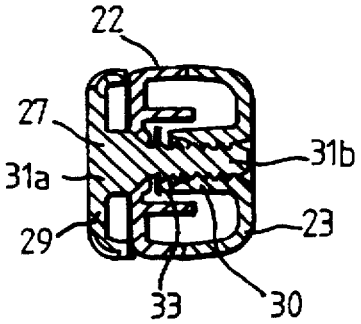
FIG. 5 is a section on line 5—5 of FIG. 1.
Figure 6:
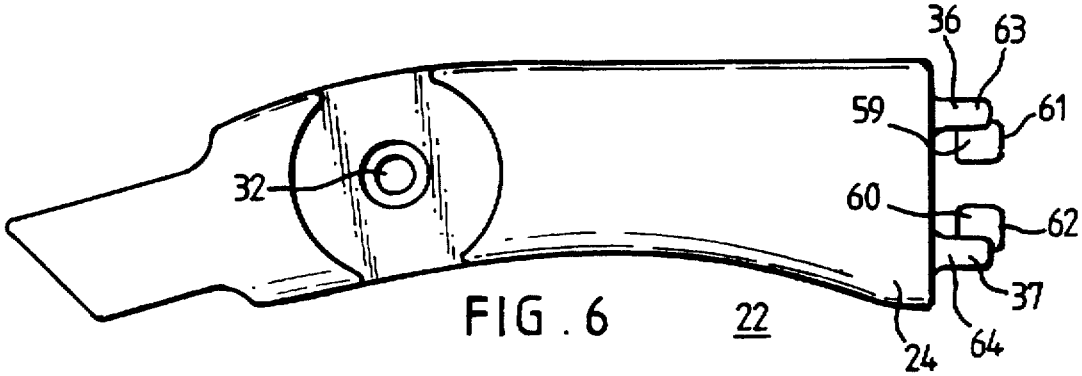
FIG. 6 is a side elevation of a first one of the two handle portions of the knife, showing the exterior of the illustrated handle portion.

The handle portions 22, 23 are releasably clamped together by a releasable clamping device 27, illustrated particularly in FIGS. 1, 2, 3 and 5, the clamping device 27 being positioned forwardly of the rear end 26 and rearwardly of a front end 28 of the handle 21. The releasable clamping device 27 comprises a manually rotatable screw-threaded device 29, captively held by the first handle portion 22. The releasable clamping device 27 also comprises a mating, internally screw-threaded hollow boss 30, forming an integral part of the second handle portion 23. The manually rotatable part 29 comprises a knurled wheel 31*a* integral with a male, that is, externally, screw-threaded shaft 31*b* (FIG. 5). The shaft 31*b* extends through a hole 32 in handle portion 22 into the interior of the handle 21 and screw-threadedly engages the boss 30 of handle portion 23. The rotatable device 29 is held captive to handle portion 22 by means of a circlip 33 fitted to the proximal end of the shaft 31*b*.

In fact, the clamping device 27 is virtually identical to a clamping device on the known "10-550" knife referred to earlier.

Figure 17:
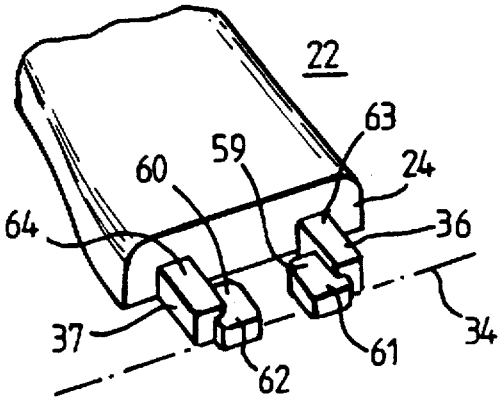
FIG. 17 is a scrap perspective view of the rear end of the first handle portion.
Figure 18:
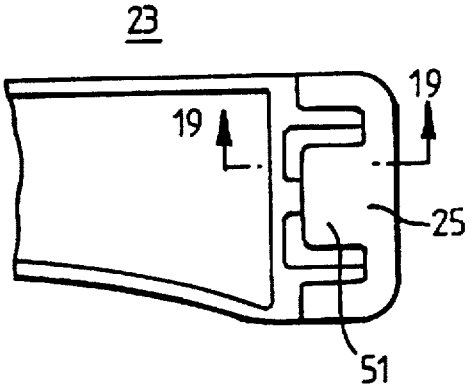
FIG. 18 is a scrap view of the rear end of the second handle portion (see also FIG. 11)

The direct interlocking inter-engagement, referred to earlier, of the rear ends 24, 25 of the handle portions 22, 23 is such that, when the clamping device 27 is released, that is to say, unscrewed, the two handle portions 22, 23 can be hinged apart (see FIGS. 20 to 23) and together, on a hinging axis 34 (FIG. 17) at the rear end 26 of the handle 21, so as to open and close the front end 28 of the handle 21.

Figure 21:
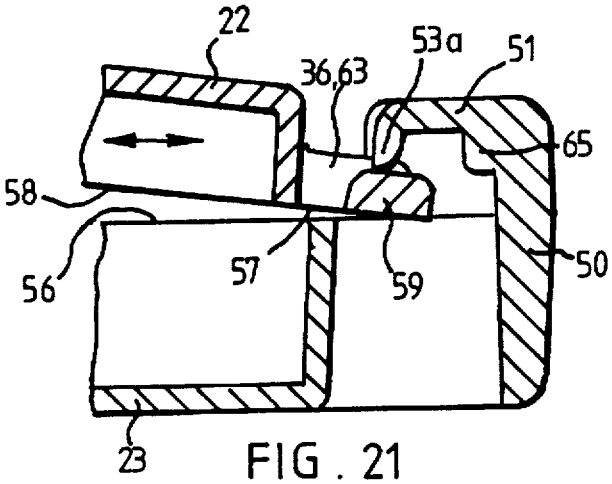
FIG. 21 is a scrap sectional view of the rear end of the knife, shown slightly open and partially dis-assembled.
Figure 22:
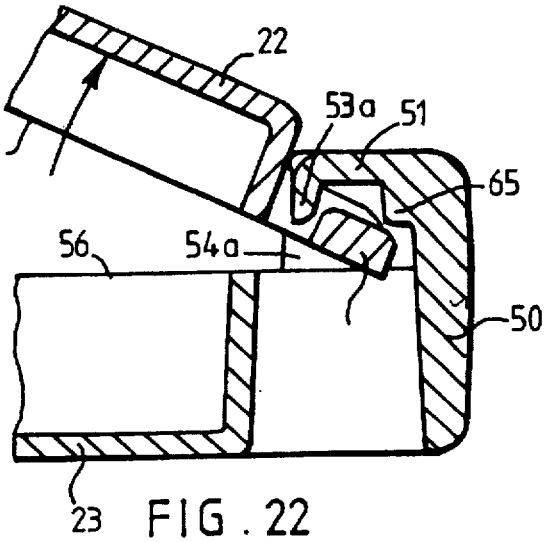
FIG. 22 is a scrap sectional view of the rear end of the knife, shown half open.
Figure 23:
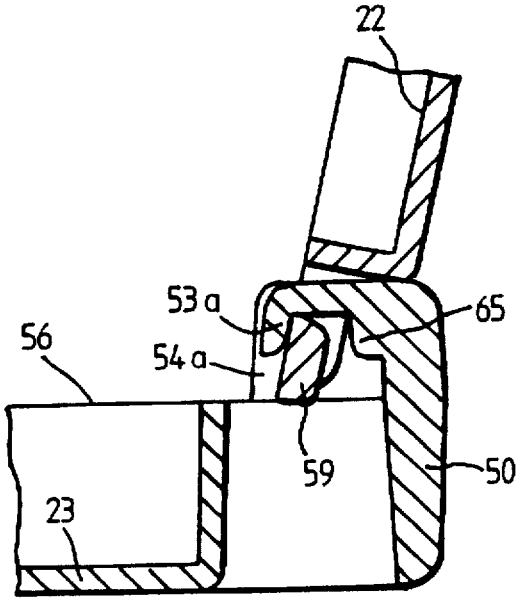
FIG. 23 is a scrap sectional view of the rear end of the knife, shown fully open.

This direct interlocking inter-engagement of the rear ends 24, 25 of the handle portions 22, 23 is also such that, when the clamping device 27 is released, the two handle portions 22, 23 can be completely disengaged from each other, see FIG. 21, and re-engaged with each other at their rear ends 24, 25, and thereby can be separated, and reconnected, when the handle portions are held at one particular predetermined angle, namely, almost closed as shown in FIG. 21, but not at other angles as shown in FIGS. 22 and 23, relative to each other.

The two handle portions 22, 23 are adapted to clamp a blade 35 therebetween at the front end 28 of the handle 21, with the plane of the blade 35 parallel with the hinging axis 34.

The above-mentioned direct interlocking inter-engagement of the rear ends 24, 25 of the handle portions 22, 23 is by means of two integral lugs 36, 37 of handle portion 22 projecting into two recesses or cavities 38, 39 respectively of handle portion 23. However, before proceeding with a detailed description of how handle portions 22, 23 are hinged together, there follows a brief description of the relative shapes of each of handle portions 22 and 23, followed by a brief description of the overall shape of the handle 21.

FIGS. 1 and 2 illustrate clearly that the first handle portion 22 is shorter than the second handle portion 23. Referring to FIG. 2, it will be seen that the overall width of the knife handle 21 is substantially uniform, right from the region of clamping device 27 back to the rear end 25 of handle portion 23. Forwardly of the clamping device 27, the handle 21 tapers quite significantly to the relatively narrow front end 28.

Figure 12:
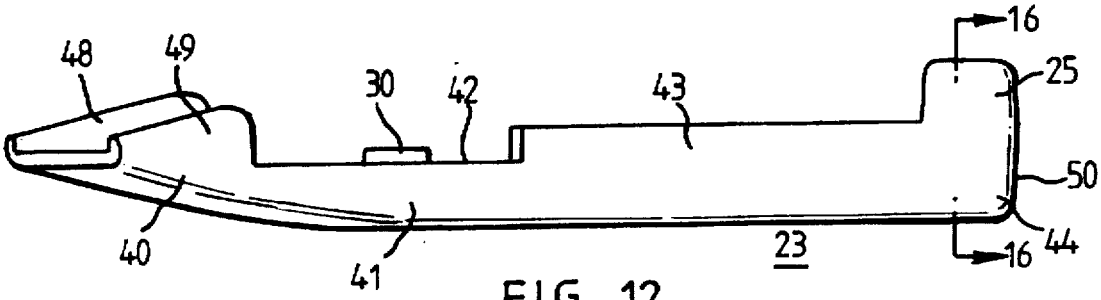
FIG. 12 is an underneath plan view of the second handle portion.
Figure 13:
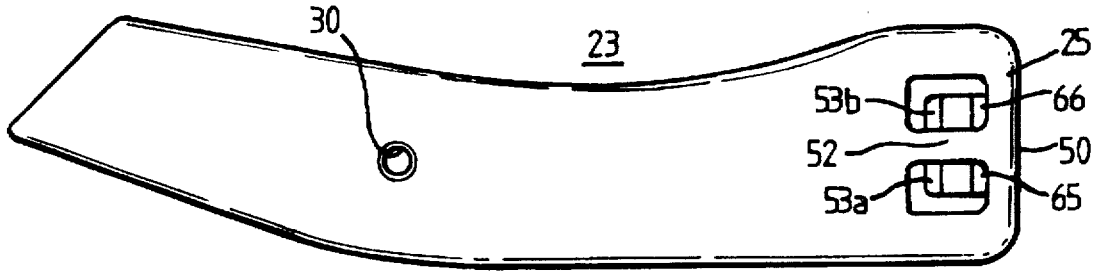
FIG. 13 is an opposite side elevation of the second handle portion on its back, showing the exterior thereof.
Figure 14:
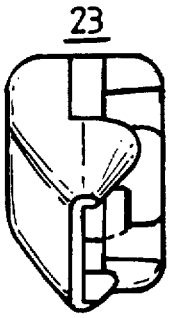
FIG. 14 is a front end view of the second handle portion.
Figure 15:
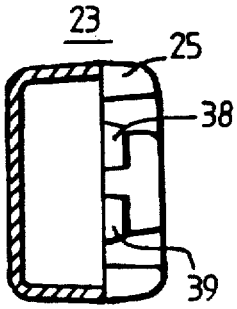
FIG. 15 is a section on line 15—15 of FIG. 11.

Describing firstly the second handle portion 23, FIG. 12 shows handle portion 23 as comprising a forwardly tapering nose portion 40, a relatively thin central portion 41, characterised by a cut-out 42. To the rear of the portion 41, characterised by the cut-out 42, is a uniformly thicker portion 43. At the rear end of handle portion 23, that is, to the rear of portion 43, and indeed to the rear of the body of handle portion 22, is a rear most portion 44 the thickness of which constitutes the full thickness of the handle 21.

Figure 7:
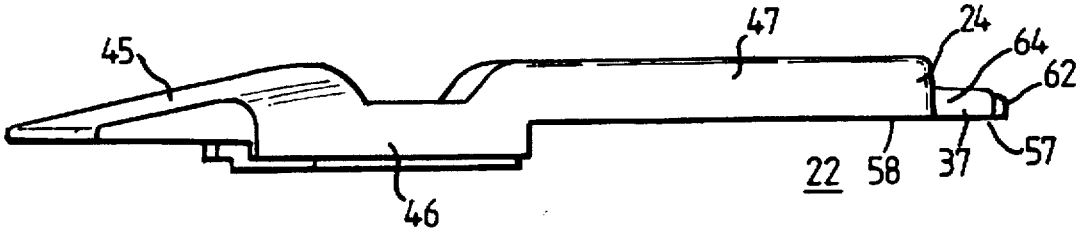
FIG. 7 is an underneath plan view of the first handle portion.
Figure 8:
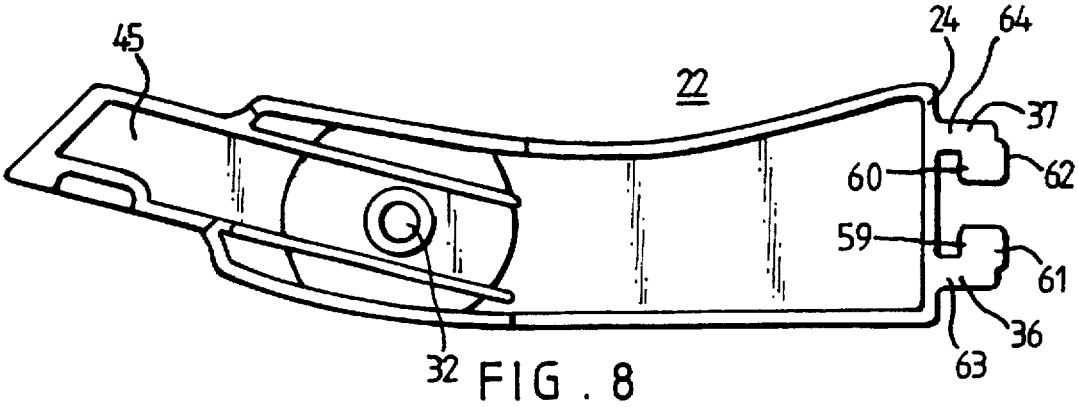
FIG. 8 is an opposite side elevation of the first handle portion, on its back, showing the interior thereof.
Figure 9:
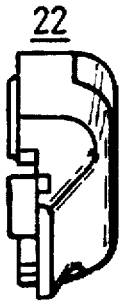
FIG. 9 is a front end view of the first handle portion.
Figure 10:
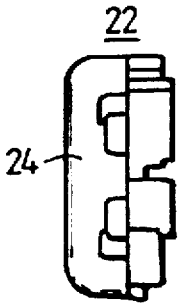
FIG. 10 is a rear end view of the first handle portion.

Referring now to FIG. 7, the first handle portion 22 comprises a nose portion 45, which tapers forwardly in a similar manner to the nose portion 40 of handle portion 23. The handle portion 22 (FIG. 7) also comprises a projecting portion 46, complementary to the cut-out 42 in handle portion 23, in the region of the clamping device 27. Rearwardly of portion 46, the handle portion 22 comprises a portion 47, the rear end of which forms the rear end 24 of handle portion 22.

It will be appreciated that nose portions 45, 40, adjacent portions 46, 41 and, finally, portions 47, 43 of handle portions 22, 23 respectively are complementary, as shown in FIG. 2. FIGS. 1 and 2 best illustrate how the nose portion 45 of handle portion 22 is of reduced width, so as to fit between wings 48, 49 (FIG. 12) of handle portion 23.

The overall shape of the handle 21 is apparent from FIGS. 1 to 4 inclusive. FIGS. 1 and 3 show that handle 21 is not straight, but is curved in a vertical plane along its centre-line. Moreover, the rear end 26 of the handle 21 is flared slightly.

It should be made clear that the shape of the handle is not crucial to the invention, in that the invention can be applied to knives with elongate handles of different shapes from that shown in the drawings.

Reference is directed once more to the direct interlocking inter-engagement of the rear ends 24, 25 of handle portions 22, 23. It has already been mentioned that lugs 36, 37 of handle portion 22 project into recesses or cavities 38, 39 of handle portion 23, more particularly, of portion 44 of handle portion 23. The height (as seen for example in FIG. 12) of portion 44 is equal to the sum of the heights of portions 47, 43 of handle portions 22, 23, as shown in FIG. 2.

At the rear end of portion 44, a rear wall 50 extends the full height and the full width of portion 44. At the top of portion 44, a top wall 51 (see especially FIGS. 11 and 16) extends forwardly from the top of wall 50. The top wall 51 is supported by a central wall 52 extending the full height of portion 44. At the front of the top wall 51, two downwardly projecting lips 53*a*, 53*b* define two restricted openings 54*a*, 54*b*, one at each side of the wall 52. More particularly, the openings 54*a*, 54*b* are between the bottom edges of the lips 53*a*, 53*b* on the one hand and an upper surface 56 of the second handle portion 23 on the other hand. The surface 56 is completely flat and extends right back to the rear wall 50 (see FIG. 19, which shows cavity 38 with lip 53a and restricted opening 54*a*).

Figure 20:
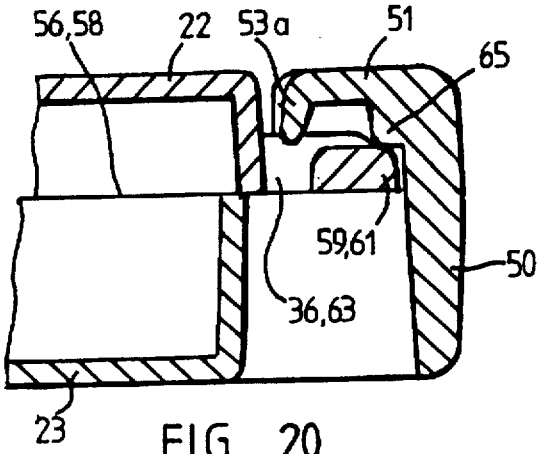
FIG. 20 is a scrap sectional view of the rear end of the knife, shown closed.

As shown most clearly in FIG. 7, the lugs 36, 37 have flat undersides 57 which are similarly coplanar with a flat surface 58 of the portion 47. By virtue of the flat surfaces 56, 57 and 58, it is possible to introduce the lugs 36, 37 into the recesses or cavities 38, 39 through the restricted openings 54*a*, 54*b* when the handle portions 22, 23 are almost closed together as shown in FIG. 21. In practice, the handle portions 22.23 can not be separated and reconnected when completely closed as shown in FIG. 20, because of the need to introduce the tip of the shaft 31*b* into the boss 30.

As clearly shown in the drawings, the lugs 36, 37 comprise lateral extensions 59, 60 which, when the handle portions 22, 23 are hinged to open positions as shown in FIGS. 22 and 23, are entrapped behind the lips 53*a*, 53*b*, so that the handle portions 22, 23 can not then be detached or separated.

Most importantly, the lateral projections 59, 60 have portions 61, 62 projecting rearwardly of the stems 63, 64 of lugs 36, 37. These projections 61, 62 are to the rear of the hinging axis 34 and form abutments, the function of which is described hereinafter.

Figure 16:
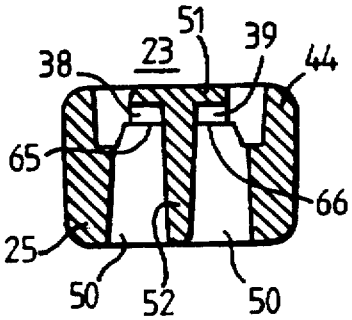
FIG. 16 is a section on line 16—16 of FIG. 12.
Figure 19:
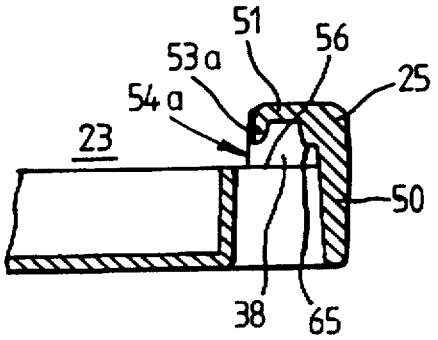
FIG. 19 is a section on line 19—19 of FIG. 18.

Referring to FIGS. 16 and 19, the handle portion 23 is provided with corresponding abutments 65, 66 in the recesses or cavities 38, 39 at, the junction of the rear wall 50 and top wall 51. As shown in FIG. 20, the portions 61, 62 engage the abutments 65, 66 when the handle portions 22, 23 are closed, so as to prevent separation of the handle portions 22 and 23 at the rear end 26 of handle 21. Because the portions 61 and 62, as well as the abutments 65, 66, are to the rear of the hinging axis 34, the portions 61 and 62 move away from the abutments 65, 66 when the handle portions 22 and 23 are opened, and thus do not interfere with the hinging ability of handle portions 22, 23. Nor do the abutments 61, 62, 65, 66 interfere with the separation and reconnection of the handle portions 22, 23 when the lugs 36, 37 are withdrawn from and reintroduced into the recesses, cavities or chambers 38, 39, as shown in FIG. 21.

Figure 11:
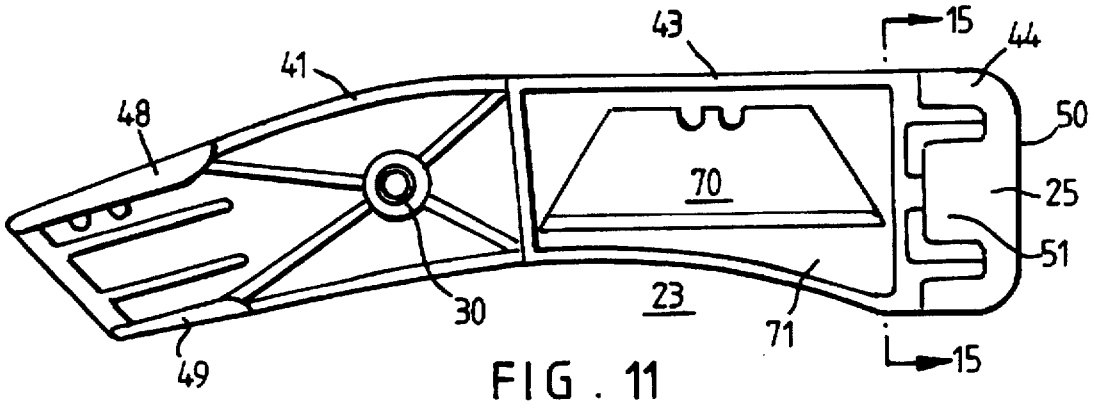
FIG. 11 is a side elevation of the second handle portion, showing its inside.

Finally, FIG. 11 shows a spare blade 70, stored in a chamber 71 within handle portion 23. The spare blade 70 can be extracted, to replace the blade 35, by opening the handle 21.

I claim:

1. A hand-held utility knife comprising an elongate handle formed by two elongate handle portions, rear ends of said handle portions being hinged together at a rear end of the handle, said handle portions being releasably clamped together by a releasable clamping device positioned forwardly of the rear end of the handle and rearwardly of a front end of the handle;

the hinging together of the handle portions being by means of direct interlocking inter-engagement of the rear ends of the handle portions, due to at least one lug of a first one of the handle portions projecting into at least one recess or cavity of the second handle portion, said at least one lug projecting generally rearwardly of said first handle portion and having a lateral extension adapted and arranged so that said extension can be introduced into and extracted from said recess or cavity of the second handle portion through a restricted opening into said recess or cavity when the handle portions are held at one particular predetermined angle, but not at other angles, relative to each other;

said direct interlocking inter-engagement of the rear ends of the handle portions being such that, when the clamping device is released, the two handle portions can be hinged apart and together, on a hinging axis at the rear end of the handle, so as to open and close the front end of the handle;

said direct interlocking inter-engagement of the rear ends of the handle portions also being such that, when the clamping device is released, the two handle portions can be completely disengaged from each other, and re-engaged with each other, at their rear ends, and thereby can be separated, and reconnected, when the handle portions are held at said one particular predetermined angle, but not at said other angles, relative to each other;

the two handle portions being adapted to clamp a blade therebetween at the front end of the handle, with the plane of the blade parallel to the hinging axis;

characterised in that mutually engageable abutments at the rear ends of the two handle portions are adapted to restrain movement apart of the two handle portions at the rear end of the handle when the handle is closed; the mutually engageable abutment on said first handle portion extending rearwardly of said hinging axis, the other of said mutually engageable abutments being carried by the other handle portion and cooperatively confronting the abutment on said first handle portion to restrain separation of the two handle portions; the relative positions of the hinging axis, on the one hand, and of said mutually engageable abutments, on the other hand, being such that the abutments move apart when the handle is hinged open.

2. A hand-held utility knife as claimed in claim 1, wherein said releasable clamping device comprises a manually rotatable screw-threaded device captively held by one of the handle portions and a mating screw-threaded part of the other handle portion.

3. The hand-held utility knife of claim 1 wherein the mutually engageable abutments are rearward of the rearwardly projecting lug.

* * * * *